United States Patent [19]

McDonald

[11] Patent Number: 4,819,901

[45] Date of Patent: Apr. 11, 1989

[54] METAL SHELF LOCK

[75] Inventor: Paul M. McDonald, Scituate, Mass.

[73] Assignee: P. X. Industries, Inc., West Hanover, Mass.

[21] Appl. No.: 214,025

[22] Filed: Jun. 27, 1988

[51] Int. Cl.[4] ..... A47G 29/02

[52] U.S. Cl. ..... 248/250; 248/243

[58] Field of Search ..... 248/235, 243, 250, 239, 248/241; 211/90, 153, 134; 108/108, 152, 157, 109

[56] References Cited

U.S. PATENT DOCUMENTS

| | | | |
|---|---|---|---|
| 717,316 | 12/1902 | Avery | 248/239 UX |
| 750,595 | 1/1904 | Campbell | 248/250 |
| 1,291,321 | 1/1919 | Whittier | 248/239 |
| 1,398,071 | 11/1921 | Forester | 248/239 X |
| 1,918,457 | 7/1933 | Dowell | 248/239 |
| 3,471,111 | 10/1969 | MacDonald | 248/235 |
| 3,471,112 | 10/1969 | MacDonald et al. | 248/239 |
| 3,870,266 | 3/1975 | MacDonald | 248/235 |
| 3,979,796 | 9/1976 | MacDonald | 24/73 |
| 4,037,813 | 7/1977 | Loui et al. | 248/250 |
| 4,053,132 | 10/1977 | Del Pozzo | 248/235 |
| 4,385,565 | 5/1983 | Roberts et al. | 108/152 |
| 4,432,523 | 2/1984 | Follows | 248/250 |
| 4,646,998 | 3/1987 | Pate | 248/250 |
| 4,666,117 | 5/1987 | Taft | 248/243 |
| 4,732,358 | 3/1988 | Hughes | 248/250 X |

FOREIGN PATENT DOCUMENTS

| | | | |
|---|---|---|---|
| 260460 | 3/1968 | Austria . | |
| 362297 | 10/1922 | Fed. Rep. of Germany | 248/239 |
| 389197 | 6/1965 | Switzerland . | |
| 1540224 | 2/1979 | United Kingdom . | |

*Primary Examiner*—J. Franklin Foss

*Attorney, Agent, or Firm*—Morse, Altman, Dacey & Benson

[57] ABSTRACT

A metal shelf lock, formed of metal for extra strength, and of improved construction is disclosed for securing shelves both vertically and horizontally in cabinets and the like. The shelf lock includes a unitary body formed of stainless steel, tempered steel, heat treated steel, spring steel, aluminum, brass or the like into essentially an L-shaped frame. The frame features an upright section and a horizontal section, with a flexible portion depending at an angle from the upright section and terminating in a tab. A hollow peg is formed in the upright section at about midway thereof and in operative association with the tab. The peg extends from the upright section in a direction opposed yet parallel to the horizontal section and at a distance less than the horizontal section. The hollow peg frictionally retains the metal shelf in a wall socket and is designed to receive the tab when the flexible portion is flexed by a shelf toward the upright section. With the shelf coming to rest on the horizontal section of the L-shaped frame, the tab is urged by the flexible portion into locking engagement with an edge of the shelf. Preferably, the upper parts of the upright section and of the flexible portion feature complementary and contiguous cutouts, the size of which affects the flexing of the flexible portion.

11 Claims, 1 Drawing Sheet

METAL SHELF LOCK

BACKGROUND OF THE INVENTION

1. Field of the Invention

The present invention relates generally to shelf supporting devices and, more particularly, to a metal shelf lock designed to secure a shelf in a cabinet against displacement during shipment and/or use.

2. The Prior Art

In the manufacture of various types of cabinets or like products which incorporate shelves, it is desirable to make the cabinet not only so that the shelves be adjustable to different heights but also so that the cabinet can be shipped with the shelves installed and without the shelves becoming loose during shipment. In prior patents, this desirable feature already has been addressed, with various degrees of success. To wit, in my U.S. Pat. No. 3,471,111, there is disclosed a combination of a shelf anchor and of a conventional shelf support that cooperate to hold a shelf against displacement during shipment. In U.S. Pat. No. 3,471,112, there is disclosed a unitary shelf support and anchor including a planar resilient finger located in spaced relation above a shoulder designed to support a shelf. The finger deflects to permit a shelf dropping onto the shoulder and then springs out to prevent displacement of the shelf. In my U.S. Pat. No. 3,870,266, there is disclosed a self-locking shelf support provided with a plug adapted to be mounted in a wall socket. The plug is formed with an axial chamber to house a pin and a spring reciprocable therein. The retractable pin holds the shelf in place during and after shipment. A panel mounting clip for mounting false drawer fronts to cabinets is disclosed in my U.S. Pat. No. 3,979,796. A one-piece plastic shelf support, featuring a smoothly curved deformable web, is taught by U.S. Pat. No. 4,053,132. A shelf support, formed as a continuous section running the entire length of the shelf, is disclosed in U.S. Pat. No. 4,395,565. A shelf support of the type featuring resiliently yeildable ear portions is disclosed in U.S. Pat. No. 4,432,523. A low profile shelf lock, featuring a resilient crescent shaped protrusion, is taught in U.S. Pat. No. 4,666,117 assigned to a common assignee herein, the P.X. Industries, Inc., of West Hanover, Mass. Austrian Patent No. 260,460 discloses an S-shaped channel for cabinet drawers. Swiss Patent No. 389,197 discloses a plurality of embodiments of one-piece plastic shelf supports. And British Patent No. 1,540,224 discloses a one-piece plastic shelf support featuring a flexible lip. Despite the availability of so many and varied shelf locks, or perhaps because of it, there is still plenty of room left for improvements.

SUMMARY OF THE INVENTION

It is a principal object of the present invention to overcome disadvantages of the prior art by providing a metal shelf lock, of metal for extra strength, and of improved construction for securing shelves both vertically and horizontally in cabinets and the like.

More specifically, it is an object of the present invention to provide a metal shelf lock of novel construction comprising a unitary body formed of stainless steel, tempered steel, heat treated steel, spring steel, aluminum, brass or the like, into essentially an L-shaped frame. The frame features an upright section and a horizontal section, with a flexible portion depending at an angle from the upright section and terminating in a tab.

A hollow peg is formed in the upright section at about midway thereof. The peg is designed frictionally to retain the metal shelf lock in a wall socket and also to receive the tab when the flexible portion is flexed by a shelf during its mounting. With the shelf mounted, i.e., when it comes to rest on the horizontal section of the L-shaped frame, the tab is urged by the flexible portion into locking engagement with an edge of the shelf, securing thereby the shelf in place. Preferably, the upper parts of the upright section and of the flexible portion feature complementary and contiguous cutouts. The size of these cutouts is chosen so as to adjust the flexing of the flexible portion to optimum for mounting, securing and dismounting a shelf between opposed metal shelf locks in a cabinet or the like.

Other objects of the present invention will in part be obvious and will in part appear hereinafter.

The invention accordingly comprises the metal shelf lock of the present disclosure, its components, parts and their interrelationships, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings, wherein.

DETAILED DESCRIPTION OF THE PREFERRED EMBODIMENT

Figure 3:
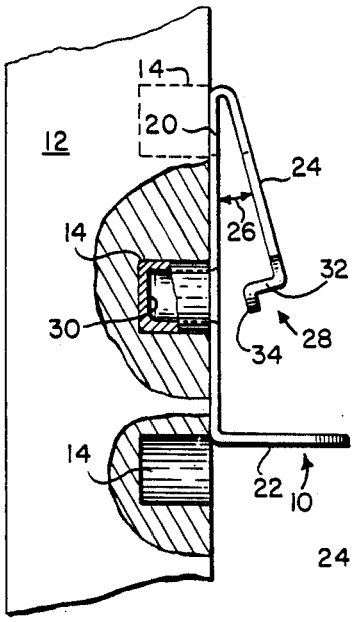
FIG. 3 is a side elevation, partly broken away, showing the metal shelf lock in operative position.

In general, the drawings illustrate an improved metal shelf lock 10 designed for releasably securing shelves to a vertical wall 12 in kitchen cabinets and the like. Preferably, the shelf lock 10 is formed of a suitable metal, such as stainless steel, tempered steel, heat treated steel, spring steel, aluminum, brass and the like by stamping and drawing it into its structural form from flat metal stock. Typically, in kitchen cabinets and the like, the wall 12 is pre-drilled with a plurality of sockets 14 at varying levels of height. Consequently, any shelves involved can be adjusted to different heights, with the ultimate consumer setting the shelf height to his own particular needs.

The metal shelf lock 10 is of a unitary body 16 construction defining essentially an L-shaped frame 18. The frame 18 includes an upright section 20 and a horizontal section 22, with a flexible portion 24 depending at an angle 26 from the upright section 20 and terminating in a tab 28. The angle 26 can range from about three to about twenty degrees, and preferably is about eleven degrees. A hollow peg 30 is formed in the upright section 20 at about midway thereof and in operative association with the tab 28. The peg 30 extends from the upright section 20 in a direction opposed yet parallel to the horizontal section 22 and at a distance less far than the length of the horizontal section 22. The peg 30 is designed frictionally to retain the metal shelf lock 10 in one of the plurality of wall sockets 14 and also to receive the tab 28 therein when the flexible portion 24 is flexed toward the upright section 20. The tab 28 is formed with a first segment 32 substantially normal to the flexible portion 24 and a second segment 34 substantially normal to the first segment 32.

Figure 1:
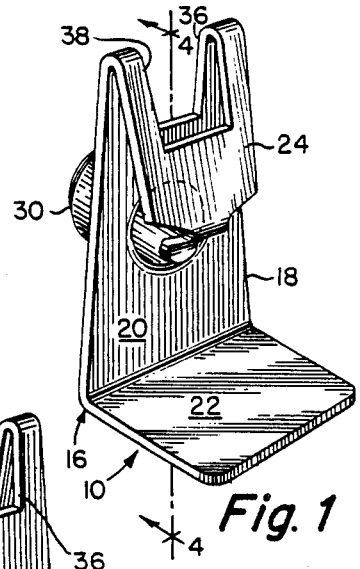
FIG. 1 is a front perspective view of a metal shelf lock constructed according to the invention.
Figure 2:
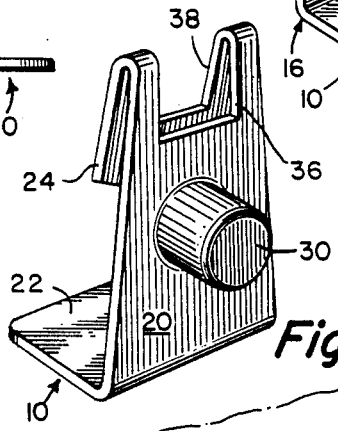
FIG. 2 is a rear perspective view of the metal shelf lock of FIG. 1.

As may be best observed in FIGS. 1 and 2, the upright section 20 is confined between side edges which converge slightly in a direction away from the horizontal section 22. This is intended to lower the center of gravity of the metal shelf lock's 10 construction. Due to this low center of gravity, the metal shelf lock 10 of the invention exhibits little, if any, tendency to flip upside down even when the sockets 14 are slightly oversized and as a result, there is virtually no frictional engagement by the hollow peg 30 with the internal walls of the sockets 14.

The upper part of the upright section 20 further is provided with a cutout 36 which is complementary to and contiguous with a second cutout 38 in the upper part of the flexible portion 24. The primary reason for providing these respective cutouts 36 and 38 is to provide the flexible portion 24 with the required flexibility to accomplish its required function, as will be more fully described below. As evident, the size of the cutouts 36 and 38 materially influences the flexing of the flexible portion 24 toward and away from the upright section 20. These cutouts 36 and 38 also contribute to the lowering of the center of gravity of the metal shelf lock 10, achieving thus a combined advantage.

Figure 4:
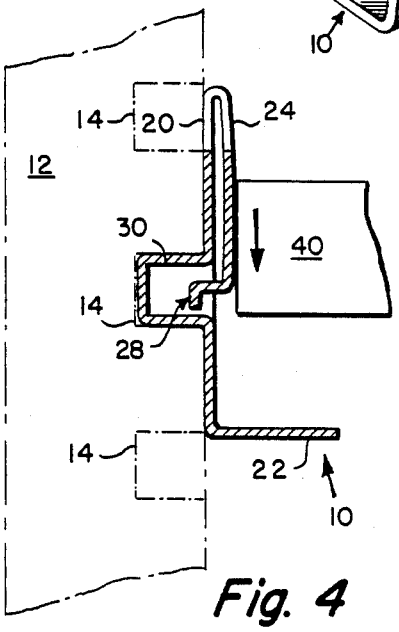
FIG. 4 is a section along the line 4-4 of FIG. 1 and similar to FIG. 3 but showing a shelf in the process of being mounted within the shelf lock.
Figure 5:
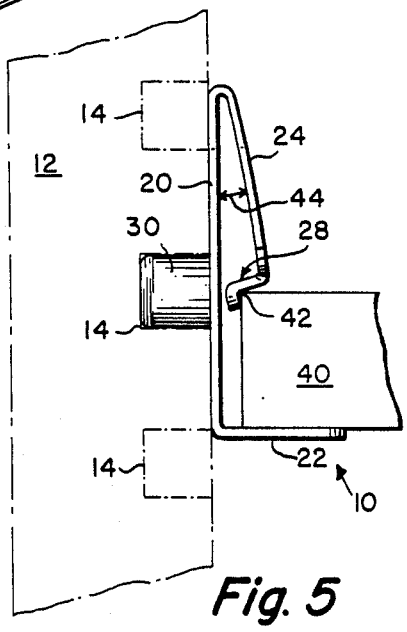
FIG. 5 is a view similar to FIG. 4 but shows the shelf secured within the shelf lock.

In operation, a pair of metal shelf locks 10 are positioned in sockets 14 located at the same height in opposed walls 12 of a cabinet or the like. For most applications, two of such opposed shelf locks 10 are satisfactory. With the metal shelf locks 10 in place, as illustrated in FIG. 3, a shelf 40 is lowered into place thereon, as illustrated in FIG. 4. Initially, the edge of the shelf 40 deflects the flexible portion 24 toward the upright section 20, with the tab 28 entering into the hollow peg 30, substantially as shown. When the shelf 40 comes to rest on the horizontal section 22 of the metal shelf lock 10, as illustrated in FIG. 5, a corner 42 of the shelf 40 is secured in a locking engagement by the tab 28 of the flexible portion 24, which is still under some tension and remains so to securely hold the shelf 40. Note that the angle 26 with which the flexible portion 24 normally depends from the upright section 20, FIG. 3, has now been compressed to a smaller angle 44. Typically, a normal angle of about twelve degree, as represented by the arrow 26, has now been reduced by about two degrees, i.e., to about ten degrees, as represented by the arrow 44. This reduction of about two degrees provides sufficient stored energy in the metal shelf lock 10, specifically in its stabilizing tab 28, safely and securely to retain the shelf 40, both vertically and horizontally, between a pair of such opposed metal shelf locks 10. The shelf 40, in addition to being securely locked in place, also is stabilized end to end, i.e., centered, between the pair of such opposed metal shelf locks 10. As is customary, the shelf 40 is precut to length for a particular cabinet. There is thus virtually no play in the shelf 40 when the same is installed, as above described. The shelf 40 is readily removable by depressing the flexible portion 24 toward the upright section 20 until its tab 28 once again is received within the hollow peg 30. The edge 42 of the shelf 40 is now free of both the tab 28 and the flexible portion 24 so that it can be lifted upward and out of engagement with the metal shelf lock 10 of the invention.

As mentioned, the metal shelf lock 10 of the invention preferably is formed of flat metal stock by stamping, repeated drawing, and shaping the same into its illustrated and described structure. The shaping of the metal shelf lock 10 preferably is effected in a manner that all edge and corners thereof are smooth, facilitating its safe handling. It is thus of one unitary metal body 16 that gives it, in addition to its unique structure, the strength and endurance of its component metal, be it stainless steel, tempered steel, heat treated steel, spring steel, aluminum, brass or the like.

Thus it has been shown and described a metal shelf lock 10 designed for securing shelves both vertically and horizontally in cabinets or the like, which metal shelf lock 10 satisfies the objects and advantages set forth above.

Since certain changes may be made in the present disclosure without departing from the scope of the present invention, it is intended that all matter described in the foregoing specification or shown in the accompanying drawings, be interpreted in an illustrative and not in a limiting sense.

What is claimed is:

1. A metal shelf lock comprising:

(a) a unitary body formed of a metal and having an L-shaped frame;

(b) said L-shaped frame including an upright section and a horizontal section;

(c) a flexible portion connecting at an angle to said upright section and provided with a tab at its free end; and (d) a hollow peg formed in said upright section in operative association with said tab and extending from said upright section in a direction opposed yet parallel to said horizontal section;

(e) said upright section being confined between edges which converge in a direction away from said horizontal section.

2. The metal shelf lock of claim 1 wherein said angle ranges from about three to about twenty degrees, and wherein said metal is at least one of a group consisting of stainless steel, tempered steel, heat treated steel, spring steel, aluminum, and brass.

3. The metal shelf lock of claim 1 wherein an upper part of said upright section and an upper art of said flexible portion are each provided with a cutout complementary and contiguous to one another.

4. The metal shelf lock of claim 1 wherein said tab is formed with a first segment substantially normal to said flexible portion and a second segment substantially normal to said first segment.

5. The metal shelf lock of claim 1 wherein said shelf lock is designed for securing, both vertically and horizontally, a shelf between opposed cabinet walls provided with a plurality of sockets, each of said sockets configured to receive and frictionally retain therein said hollow peg of said shelf lock, and wherein said shelf, once secured, also is stabilized end to end between said opposed cabinet walls.

6. The metal shelf lock of claim 5 wherein said shelf is supported on said horizontal portion of said L-shaped frame, with said tab being urged by said flexible portion into locking engagement with an edge of said shelf, and, wherein said shelf is removable from said locking engagement by pressing said flexible portion toward said upright section until said tab is substantially received within said hollow peg.

7. A metal shelf lock comprising:

(a) a unitary body formed of a metal and having an L-shaped frame;

(b) said L-shaped frame including an upright section and a horizontal section;

(c) a flexible portion connecting at an angle to said upright section and provided with a tab at its free end; and (d) a hollow peg formed in said upright section in operative association with said tab and extending from said upright section in a direction opposed yet parallel to said horizontal section;

(e) said hollow peg configured to receive therein said tab when said flexible portion is flexed toward said upright section.

8. A metal shelf lock for securing a shelf between opposed cabinet walls having a plurality of sockets formed therein comprising:

(a) a unitary metal body of L-shaped construction including an upright section and a horizontal section;

(b) a flexible portion depending at an angle from said upright section toward said horizontal section and terminating in a tab;

(c) a hollow peg formed in said upright section at about midway thereof and in operative association with said tab, said peg extending therefrom in a direction opposed yet parallel to said horizontal section at a distance less than said horizontal section; and (d) complementary and contiguous cutouts provided in both said upright section and said flexible portion, said cutouts serving to allow for flexing of said flexible portion toward said upright section.

9. The metal shelf lock of claim 8 wherein said metal is at least one of a group consisting of stainless steel, tempered steel, heat treated steel, spring steel, aluminum and brass and, wherein said angle ranges from about three to about twenty degrees, and wherein said upright section converges at its sides away from said horizontal section and, wherein all edges and corners of said unitary metal body are smooth.

10. The metal shelf lock of claim 8 wherein said shelf is supported on said horizontal section of said unitary metal body, with said tab being urged by said flexible portion into locking engagement with an edge of said shelf and, wherein said shelf is removable from said locking engagement by pressing said flexible portion toward said upright section until said tab is substantially received within said hollow peg, and wherein said shelf, upon being secured between said opposed cabinet walls, also is stabilized end to end therebetween.

11. A metal shelf lock for securing a shelf between opposed cabinet walls having a plurality of sockets formed therein comprising:

(a) a unitary metal body of L-shaped construction including an upright section and a horizontal section;

(b) a flexible portion depending at an angle from said upright section toward said horizontal section and terminating in a tab;

(c) a hollow peg formed in said upright section at about midway thereof and in operative association with said tab, said peg extending therefrom in a direction opposed yet parallel to said horizontal section at a distance less than said horizontal section;

(d) said tab formed with a first segment substantially normal to said flexible portion and a second segment substantially normal to said first segment and, wherein said hollow peg is configured to receive therein said second segment and a portion of said first segment of said tab when said flexible portion is flexed toward said upright sections.

* * * * *

UNITED STATES PATENT AND TRADEMARK OFFICE

CERTIFICATE OF CORRECTION

PATENT NO. : 4,819,901

DATED : April 11, 1989

INVENTOR(S) : Paul M. MacDonald

It is certified that error appears in the above-identified patent and that said Letters Patent is hereby corrected as shown below:

On the title page inventor should read

-- Paul M. MacDonald --.

Signed and Sealed this

Fifth Day of December, 1989

*Attest:*

JEFFREY M. SAMUELS

*Attesting Officer*

*Acting Commissioner of Patents and Trademarks*